United States Patent [19]

Barton

[11] Patent Number: 4,667,447

[45] Date of Patent: May 26, 1987

[54] COATED ABRASIVE SHEET MATERIAL MAGNETICALLY ATTACHED TO A SUPPORT SURFACE ON AN ABRADING TOOL

[75] Inventor: James J. Barton, Maplewood, Minn.

[73] Assignee: Minnesota Mining and Manufacturing Company, Saint Paul, Minn.

[21] Appl. No.: 913,627

[22] Filed: Sep. 30, 1986

Related U.S. Application Data

[63] Continuation of Ser. No. 837,855, Mar. 5, 1986, abandoned, which is a continuation of Ser. No. 528,043, Aug. 31, 1983, abandoned.

[51] Int. Cl.[4] ..... B24D 11/00

[52] U.S. Cl. ..... 51/362; 51/391; 51/401; 15/97 R; 15/230; 428/144; 428/148; 335/285; 335/303

[58] Field of Search ..... 51/358, 362, 376, 391, 51/401, 402, 404, 406, 407, 394, 309, 297, DIG. 34; 15/97 R, 98, 230; 335/285, 303, 306; 428/143, 144, 148, 149

[56] References Cited

U.S. PATENT DOCUMENTS

| | | | |
|---|---|---|---|
| 529,990 | 11/1894 | Wyckoff et al. | 51/309 X |
| 774,444 | 11/1904 | Mitchell et al. | 51/309 X |
| 2,056,182 | 10/1936 | Gardner | 51/110 |
| 2,175,073 | 10/1939 | Amstuz | 51/401 |
| 2,503,619 | 4/1950 | Hopps et al. | 51/187 |
| 2,662,353 | 12/1953 | Bergman et al. | 51/187 |
| 2,705,194 | 3/1955 | St. Clair | 51/309 X |
| 2,797,370 | 6/1957 | Bennett | 335/303 |
| 3,075,323 | 1/1963 | Weir | 51/362 X |
| 3,226,888 | 1/1966 | Erenyi | 51/362 |
| 3,253,201 | 5/1966 | Slatkin | 317/262 |
| 3,510,992 | 5/1970 | Hutchins | 51/358 X |
| 3,629,756 | 12/1971 | Holtz | 335/303 X |
| 4,222,204 | 9/1980 | Benner | 51/362 |
| 4,236,357 | 12/1980 | Frantzen | 51/309 |

*Primary Examiner*—Robert P. Olszewski
*Attorney, Agent, or Firm*—Donald M. Sell; James A. Smith; William L. Huebsch

[57] ABSTRACT

A flexible, low mass coated abrasive sheet material magnetically held on a support surface of a magnetized pad providing more than 6 magnetic poles per inch in one direction along the support surface. The coated abrasive sheet material incorporates sufficient ferromagnetic material that only the force of magnetic attraction between the magnetized pad and the ferromagnetic material and any force applied to the sheet material through the magnetized pad normal to the support surface will produce sufficient static friction between the support surface and the coated abrasive sheet material to retain the abrasive coated sheet material on the support surface while it is driven by the magnetized pad to abrade a workpiece.

19 Claims, 13 Drawing Figures

COATED ABRASIVE SHEET MATERIAL MAGNETICALLY ATTACHED TO A SUPPORT SURFACE ON AN ABRADING TOOL

This is a continuation of application Ser. No. 837,855 filed Mar. 5, 1986 which was a continuation of application Ser. No. 837,855 filed Mar. 5, 1986 which was a continuation of application Ser. No. 528,043 filed Aug. 31, 1983 now both abandoned.

TECHNICAL FIELD

This invention relates to means for magnetically attaching coated abrasive sheet material to a support surface on an abrading tool.

BACKGROUND ART

Various means have been used for releasably attaching coated abrasive sheet material to a support surface on a tool to abrade a workpiece. Such means have included clamps which engage the ends of rectangular sheet material or the periphery or center of circular sheet material. Such clamps can be inconvenient to use, however, and may have separable parts or require the use of tools that can be misplaced.

Another approach has been to coat the back of the coated abrasive sheet material with pressure-sensitive adhesive and adhere it to a support surface of a tool which permits the sheet material to be peeled off after use. While such pressure-sensitive adhesive coated abrasive sheet material is relatively easy to attach and remove, the adhesive adds significantly to its cost. Also, adhesion to the support surface can be adversely affected if dust (which is normally present in the workplace) or water (which is used in some abrading processes) comes in contact with the layer of pressure-sensitive adhesive, so that new or partially used sheets must be carefully protected from such contact.

Some prior art attempts have been made to utilize magnetism for attaching coated abrasive sheet material to a support surface on an abrading tool; see e.g., U.S. Pat. Nos. 3,226,888; and 4,222,204. The structures for magnetically attaching described in these patents, however, apparently did not attach the coated abrasive sheet material to the support surface so that only the force of magnetic attraction and any force applied to the sheet material through the tool normal to the support surface would produce sufficient static friction between the coated abrasive sheet material and the support surface to retain the sheet material on the support surface while it was driven by the tool to abrade a workpiece. Instead these structures included mechanical interlocking rims or lugs to help retain the coated abrasive sheet material on the support surface, and portions of the structures incorporated with the coated abrasive sheet material added significantly to its cost.

DISCLOSURE OF INVENTION

The present invention provides a cost effective and efficient means for magnetically attaching disposable coated abrasive sheet material to a support surface on a tool so that clamps, adhesives, or interlocking portions between the sheet material and the tool are not required to retain the sheet material in place while the tool is used for abrading a workpiece.

The means according to the present invention for magnetically attracting the coated abrasive sheet material to the abrading tool comprises (1) incorporating into the tool a magnetized pad which defines the support surface and has more than 6 magnetic poles per inch in at least one direction along the support surface, and (2) providing a coated abrasive sheet material that has relatively low mass, is sufficiently flexible that it can intimately conform to the support surface, and incorporates sufficient ferromagnetic material (e.g., an average of more than about 0.007 gram of iron per square centimeter) so that only the force of magnetic attraction between the magnetized pad and the ferromagnetic material in the flexible coated abrasive sheet material and any force applied to the sheet material through the magnetized pad normal to the support surface will produce sufficient static friction between the support surface and the sheet material to retain the coated abrasive sheet material on the support surface while it is driven by the magnetized pad to abrade a workpiece. This means for magnetically attaching is sufficiently effective that it can drive the coated abrasive sheet material either when the magnetized pad is part of a tool that is manually manipulated, or when it is part of a tool having a drive motor that reciprocates, oscillates or rotates the pad, such as an air or electrically operated file, sander or rotary grinder. Thus, no mechanical clamps, adhesive, or mechanical interlocking portions are needed to hold the coated abrasive sheet material, and no tools are needed to remove or replace it. Dust and water can be wiped off the coated abrasive sheet material and will not significantly decrease the magnetic attraction between the sheet material and the support surface. In fact, water has been found to increase the degree of attraction between the coated abrasive sheet material and the support surface, perhaps because of a surface tension effect therebetween.

DETAILED DESCRIPTION OF THE INVENTION

While any ferromagnetic material such as cobalt or nickel or black iron oxide can be incorporated in the coated abrasive sheet material, the preferred ferromagnetic material is iron, which is the least expensive and develops the greatest holding power per unit weight.

It is essential that the magnetized pad has more than 6 magnetic poles per inch, or at least about 8 magnetic poles per inch in at least one direction along its support surface to develop the necessary magnetic holding force between the pad and the ferromagnetic material in the flexible coated abrasive sheet material. The preferred material for the magnetized pad is the material commercially designated "Plastiform" available from Minnesota Mining and Manufacturing Company of St. Paul, Minnesota, which is flexible, comprises magnetized particles within a polymeric matrix, and is available with 4, 6, 8, 11 and 18 magnetic poles per inch in one direction along its surface. Increasing the number of poles per inch in the magnetized pad above 8 (e.g., to 11 or 18 poles per inch) will increase this holding force at the support surface, however, with the "Plastiform" material it will also decrease the distance that a magnetic field of sufficient strength to produce this holding force will extend or reach from the support surface. This decrease would be of little concern if all of the ferromagnetic material could be located, and would remain located, on the support surface during manual or mechanical manipulation o the magnetized pad to abrade a workpiece. In practice, however, at least some of the ferromagnetic material in the coated abrasive sheet material (1) always will be spaced from the support surface either by other ferromagnetic material or by one or more portions of the coated abrasive sheet material, such as that portion in which the ferromagnetic material is contained or that portion which adheres the ferromagnetic material in place; (2) can be separated from the support surface by residual stresses in the coated abrasive sheet material produced either during manufacture of the sheet material or by bending the sheet material after it is manufactured, which residual stresses may not allow the coated abrasive sheet material to closely conform to the support surface if the coated abrasive sheet material is not sufficiently flexible; and (3) can become separated from the support surface while the coated abrasive sheet material is being driven by the pad to abrade a workpiece due to flexing of the coated abrasive sheet material away from the support surface. Thus, the ferromagnetic material should be incorporated in the coated abrasive sheet material by means that allows the ferromagnetic material to be positioned as close as possible to the support surface while being in a form that affords sufficient flexibility for the coated abrasive sheet material that the ferromagnetic material will reliably be positioned as close as possible to the support surface when the coated abrasive sheet material is placed on the magnetized pad; and the magnetized pad driving the coated abrasive sheet material should produce a magnetic field of sufficient strength to hold the coated abrasive sheet against the support surface that extends or reaches sufficiently from the support surface that the coated abrasive sheet material will be returned to the support surface under the influence of that magnetic field after any flexing of the sheet material away from the support surface that will normally result from the sheet material's intended use. Thus "Plastiform" magnetic pads having 18 pole per inch are preferred for applications such as in rotary grinders where the coated abrasive sheet material tends to stay flat against the support surface of the magnetized pad during use; whereas "Plastiform" magnetic pads having 11 poles per inch may be preferred for applications such as reciprocating files where the coated abrasive sheet material may flex away from the support surface during use, since, though their magnetic fields have less holding force at the support surface, the portions of their magnetic fields that are of sufficient strength to hold the coated abrasive sheet extend farther from their support surfaces and thus maintain a stronger magnetic attachment with the coated abrasive sheet material during such flexings.

Ferromagnetic materials in the form of thin sheets, strips, screen, fibers or granules (which may be generally round or in the shape of platelets) can be incorporated at any location in the coated abrasive sheet material such as within the layer of abrasive grains, within or as the backing sheet, or on a surface of the backing sheet opposite the layer of abrasive grains by any appropriate dispersing, coating or laminating method.

Laminating a thin sheet of ferromagnetic material (e.g., steel shim stock) to the side of the backing sheet opposite the layer of abrasive grains, or using the thin sheet of ferromagnetic material as the backing sheet to which the layer of abrasive grain is attached, places the ferromagnetic material in the thinnest possible layer on the support surface and thus will produce the maximum magnetic force between a given magnetized pad and the coated abrasive sheet material. Such thin sheets of ferromagnetic material are relatively expensive, however, and in thicker forms (e.g., above about 0.005 inch or 0.013 centimeter thick for sheets of steel) become sufficiently inflexible that the coated abrasive sheet material may not closely conform to the support surface, particularly if the coated abrasive sheet material is creased prior to use.

It is preferred to incorporate small individual pieces of ferromagnetic materials in the form of particles or granules in a layer on a surface of the backing sheet opposite the layer of abrasive grains because granules afford maximum flexibility of the sheet material per given amount of the ferromagnetic material, and are usually the least expensive form of the ferromagnetic material. The ferromagnetic granules can be adhered to the surface of the backing sheet opposite the layer of abrasive grains by a variety of adhesive types including solvent-based, water-based, or hotmelt adhesive. The adhesive should wet and cover the granules of ferromagnetic material to protect them from oxidation, and should adhere the granules in the thinnest possible layer to afford placing the granules as close as possible to the support surface of the magnetized pad. Adhesives that have been found particularly useful for this purpose include polyester resins, latexes, and vinyl acetate copolymers. While such adhered layers of granular ferromagnetic material will not be so thin as a sheet of the same ferromagnetic material for a given amount of ferromagnetic material per unit area, an adhered layer of granular ferromagnetic material can contain a significantly larger amount of ferromagnetic material per unit area while still having much more flexibility than a sheet of ferromagnetic material.

When adhered in such a layer, commercially available iron granules that have been screened through screens having meshes in about the 100 to 270 range so that they have maximum sizes in the range of about 50 to 150 microns have been found to produce, per unit weight of granules, the highest holding force between a given magnetized pad and coated abrasive sheet material under most conditions. When the same commercially available iron granules are screened through a 50 mesh screen and then adhered to the surface of a backing sheet opposite its layer of abrasive grains, the larger granules (which may be up to about 300 microns in diameter) apparently produce sufficient physical separation between the support surface of the magnetized pad and the smaller granules that the magnetic holding force between the magnetized pad and the coated abrasive sheet material is reduced when compared to holding force between the same magnetized pad and a coated abrasive sheet material incorporating granules screened through screens in the 100 to 270 mesh range. This reduction is particularly pronounced when the magnetized pad has 18 poles per inch, apparently because a magnetic field of sufficient strength to hold the coated abrasive sheet against the support surface extends a shorter distance from the support surface of such a magnetized pad than from the support surface of a magnetized pad with fewer poles per inch. Commercially available iron granules that have been screened through a 325 mesh screen and thus have maximum sizes to about 44 microns seem to produce slightly less holding force than is produced by the same weight per area of granules screened through larger screens in the 100 to 270 mesh range, perhaps because of oxidation that has occurred on or is included with the smaller granules.

It has been found useful to process commercially available iron granules in a ball mill, which removes projections from the granules and forms then into platelet-shaped granules, thereby making them more compact so that they can be coated in a thinner layer than the same weight of granules that have not been so processed.

The ferromagnetic granules can be adhered to the backing sheet before or after the layer of abrasive grains is applied. There is some indication that the presence of the ferromagnetic granules on the surface of a backing sheet opposite that on which abrasive grains are being coated will reduce the energy required for conventional electrostatic coating of the abrasive grains and will improve the sharpness of the coated abrasive. No conclusive tests have yet been preformed to support this indication, however.

Ferromagnetic material may also be incorporated within a liner sheet or adhered on a liner sheet by an adhesive such as those indicated above and the liner sheet applied over the pressure-sensitive adhesive layer on commercially available coated abrasive sheet material of the type having a layer of pressure-sensitive adhesive on the major surface of its backing sheet opposite its layer of abrasive grains (e.g., the type commercially designated "STIKIT" which is available from Minnesota Mining and Manufacturing Company, St. Paul, Minn.). This allows the resultant abrasive coated sheet material to be used on the support surface of the magnetized pad described herein by leaving the liner sheet in place, and still allows that commercially available abrasive coated sheet material to be adhered to a suitable support surface of a non-magnetized pad by stripping the liner sheet away. Alternatively, such a liner sheet coated or filled with ferromagnetic material may be coated with pressure sensitive adhesive and adhered by that pressure-sensitive adhesive to the back surface of conventional coated abrasive sheet material so that it may be used on the magnetized pad.

The ferromagnetic material can be incorporated in the backing sheet of the coated abrasive sheet material by mixing it with the wood pulp slurry from which the paper backing sheet is made. While granules of the ferromagnetic material can be used for this purpose, preferablysmall individual pieces in the form of fibers of the ferromagnetic material are used, since fibers are more easily and evenly mixed with the other fibers from which the backing sheet is made and have less tendency to settle out. With either form of the ferromagnetic material the thickness of the backing sheet will normally separate a percentage of the incorporated ferromagnetic material a greater distance from the support surface of the magnetized pad on which the backing sheet is positioned than the distance the same percentage of ferromagnetic material would be separated if it were in a thin layer on the surface of the backing sheet opposite the layer of abrasive grains. Thus, generally more ferromagnetic material will be needed to produce the same holding force between the magnetized pad and the coated abrasive sheet material when the ferromagnetic material is incorporated in the backing sheet than when the ferromagnetic material is in a layer on the surface of the backing sheet opposite the layer of abrasive grains.

It is least preferred to incorporate the ferromagnetic granules in the layer of abrasive grains on conventional abrasive sheet material because of the separation between the ferromagnetic particles and the support surface of the magnetized pad that will then be caused by the backing sheet. Incorporating ferromagnetic granules in the layers of abrasive grains is useful, however, when the backing sheet is coated by layers of abrasive grains on both sides, particularly when it is coated with small size abrasive grains that will not produce much separation between the ferromagnetic particles and the magnetized pad (e.g., grits of 120 or smaller), and/or for abrasive sheet material that is coated with abrasive grain on both sides and is intended for use on a hand sanding block where a minimum magnetic holding force is required.

Preferably iron ferromagnetic material is used at an average density of over about 0.007 gram per square centimeter area measured in a plane parallel to the major surfaces of the backing sheet, which density has been found to produce adequate holding power between coated abrasive sheet material and magnetized pads of the type described above. However, using less than about 0.007 gram per square centimeter of iron may be adequate to hold coated abrasive sheet material against magnetized pads for some purposes such as hand sanding, particularly where the backing sheet is coated with layers of abrasive grains on both sides so that the layer of abrasive grains adjacent the magnetized pad increases the effect of friction between the coated abrasive sheet material and the support surface. Using greater average densities of iron material in the coated abrasive sheet material over the range of about 0.007 to 0.1 gram per square centimeter has been found to increase the holding force between the coated abrasive sheet material and the magnetized pad. Increasing such densities above about 0.1 gram per square centimeter when the iron is in thin sheet form does not appear to significantly increase the holding force, perhaps because of the magnetic densities of the multi-pole flexible magnet being used. Increasing such densities above 0.1 gram per square centimeter when the iron is in a form other than in a thin sheet (e.g. granular) may still significantly increase the holding force, however, since the larger amount of iron may be needed to overcome the effects of separation from the support surface on the magnetized pad caused by the portion of the coated abrasive sheet material in which it is contained.

Ferromagnetic material in any form (e.g., granules, screen, fibers or sheet) can be included in the coated abrasive sheet material in sufficient quantity to afford firm magnetic attachment of the sheet material to the magnetized pad while the sheet material still retains a relatively low mass so that such magnetic attachment can overcome the effects of momentum when the sheet material is oscillated or rapidly reciprocated (e.g., up to about 6,000 strokes per minute) or the effects of centrifugal forces due to normal imbalance or slight improper centering of circular coated abrasive sheet material when it is rapidly rotated (e.g., up to over 3,000 R.P.M.). Coated abrasive sheet material according to the present invention with up to 16 grit size will typically have an average density of less than about 0.45 gram per square centimeter measured in a plane parallel to its major surfaces, and the finer more commonly used 80 to 36 grit coated abrasive sheet material will have typically average densities in the range of about 0.10 to 0.15 gram per square centimeter when measured in that plane.

Incorporating the ferromagnetic material in such a manner so as to produce a generally uniform distribution or density across the coated abrasive sheet material is preferred because it simplifies coating of the ferromagnetic material and produces a uniform holding force across the coated abrasive sheet material. Densities of the ferromagnetic material could be varied across the coated abrasive sheet material, however, such as to produce concentrations in a concentric, circular, stripe, dot or radial pattern, if they were desired, for example to accommodate special magnetized pads, help position the coated abrasive sheet material, or save material costs.

The surface of the coated abrasive sheet material intended to lie against the support surface of the magnetized pad and the support surface should be adapted to provide a suitable coefficient of static friction therebetween. One or both of those surfaces should also provide recesses for dust particles that may become trapped therebetween so that such particles do not increase separation and thereby decrease the magnetic attraction between the magnetic pad and sheet material while acting as lubrication or ball bearings to facilitate longitudinal slippage between those surfaces. Layers of ferromagnetic granules adhered to the backing sheet, backing sheets filled with ferromagnetic granules or fibers and layers of abrasive granules normally provide suitable surfaces for both purposes. When the ferromagnetic material is in the form of thin sheets (e.g., shim stock) which normally have relatively smooth surfaces, it is preferred to form such recesses in the surfaces of the sheets intended to contact the support surface by abrading or embossing those surfaces which should also increase their coefficient of friction with the support surface.

As noted above, the flexibility of the coated abrasive sheet material should be sufficient to allow the sheet material to lie in intimate contact with the entire support surface under the influence of magnetic attraction between the magnetic poles and ferromagnetic material to maximize the holding force therebetween rather than being biased into a shape (e.g., arcuate) with portions spaced from the support surface by internal stresses in the sheet material. Coated abrasive sheet material that can be bent at least 180 degrees around a 3/8 inch or 1 centimeter diameter rod at a temperature of 70 degrees Fahrenheit and at a relative humidity of 50%, and will subsequently be held flat against the flat surface of an 11 pole per inch magnetized pad on the "Plastiform" brand magnetic material by only the magnetic attraction between the magnetic poles in the pad and an average of over about 0.007 gram of ferromagnetic material per square centimeter area measured in a plane parallel to the surface of the coated abrasive sheet material adjacent the pad is deemed to be sufficiently flexible for use in the present invention. Such flexibility of the coated abrasive sheet material will be affected by the stiffness of the backing sheet used in the sheet material, any coatings or layers of adhesive used to hold the coated abrasive sheet material together, the size of the abrasive grains, and particularly the physical form of the ferromagnetic material (i.e., whether it is in sheet, fiber or granular form). Paper backing sheets of the type commonly used in coated abrasive sheet material generally have been found to be sufficiently flexible for use in the present invention (i.e., treated or untreated paper that weighs 30 to 170 pounds per 320 square yards).

BRIEF DESCRIPTION OF DRAWING

The present invention will be further described with reference to the accompanying drawing wherein like numbers refer to like parts in the several views, and wherein.

DETAILED DESCRIPTION OF ILLUSTRATED EMBODIMENTS

Figure 1:
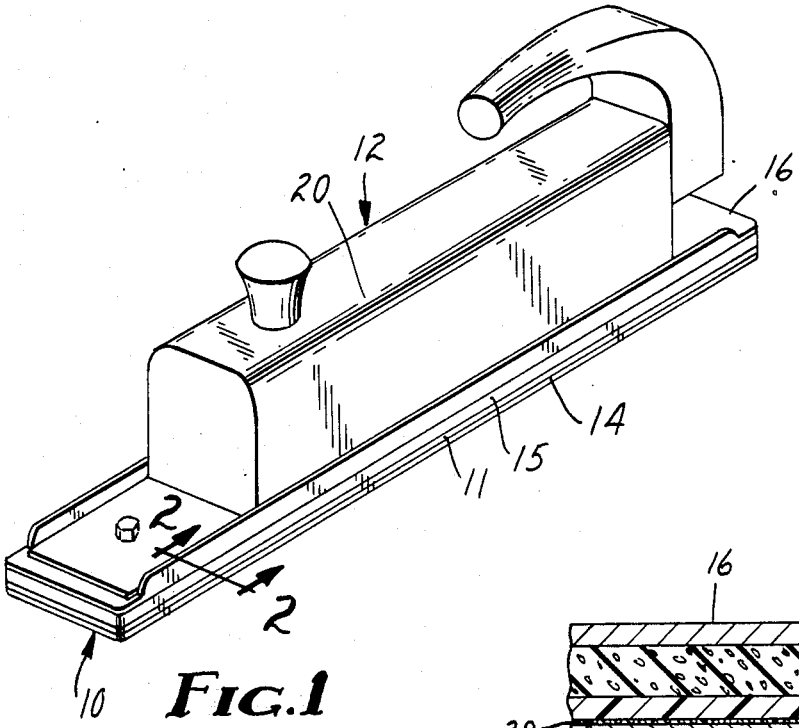
FIG. 1 shows a first embodiment of a coated abrasive sheet material according to the present invention shown magnetically attached to a magnetized pad on a reciprocating file.
Figure 2:
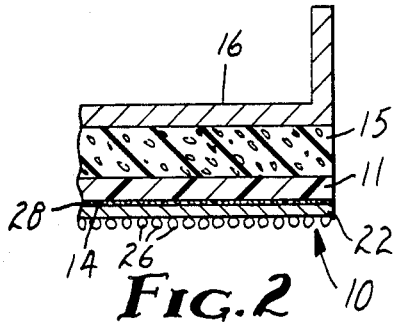
FIG. 2 is an enlarged fragmentary sectional view taken approximately along line 2—2 of FIG. 1.

Referring now to the drawing, there is shown in FIGS. 1 and 2 a piece of coated abrasive sheet material 10 and a flexible magnetized pad 11 according to the present invention adapted for use on an air file 12 of the type commonly used in auto body work, such as the air file sold under the trade designation "Atcoa Viking Dual Piston No. 85182 Air File" by Allan Air Products, Inc., St. Louis, Mo. The coated abrasive sheet material 10 is rectangular and is shown magnetically attached on a generally planar rectangular support surface 14 of the flexible magnetized pad 11. The magnetic pad 11 comprises magnetized particles within a polymeric matrix (e.g., a 0.15 centimeter thick magnetized pad 11 of the magnetized material commercially designated "Plastiform" sold by Minnesota Mining and Manufacturing Company of St. Paul, Minn. having 11 magnetic poles per inch in one direction along the support surface 14). The magnetized pad 11 is adhered on one surface of a layer 15 of foam rubber that is adhered on its surface opposite the magnetized pad 11 on a rigid backing plate 16 of the air file 12. The air file 12 includes a drive means including an air motor 20 adapted to longitudinally reciprocate the backing plate 16 and magnetized pad 11 at up to about 6000 cutting strokes per minute to abrade a workpiece (not shown). During such reciprocation only the force of magnetic attraction between the magnetized pad 11 and the flexible, relatively low mass coated abrasive sheet material 10 and any force applied to the sheet material 10 through the magnetized pad 11 normal to the support surface 14 will produce sufficient static friction between the support surface 14 and the coated abrasive sheet material 10 to retain the coated abrasive sheet material 10 on the support surface 14 while it is driven by the magnetized pad 11 to abrade the workpiece.

As is best seen in FIG. 2, the coated abrasive sheet material 10 comprises a flexible backing sheet 22 having opposite major surfaces and a layer of abrasive grains 26 adhered on one major surface by a conventional bonding material. Magnetic attachment between the coated abrasive sheet material 10 and the magnetized pad 11 is provided by a layer 28 of ferromagnetic (e.g., iron) particles having a uniform density of over about 0.007 gram per square centimeter of area (and preferably in the range of about 0.015 to 0.03 gram per square centimeter of area) measured in a plane parallel to the major surfaces of the backing sheet 22 and adhered by an adhesive on the surface of the backing sheet 22 opposite the layer of abrasive grains 26.

Figure 3:
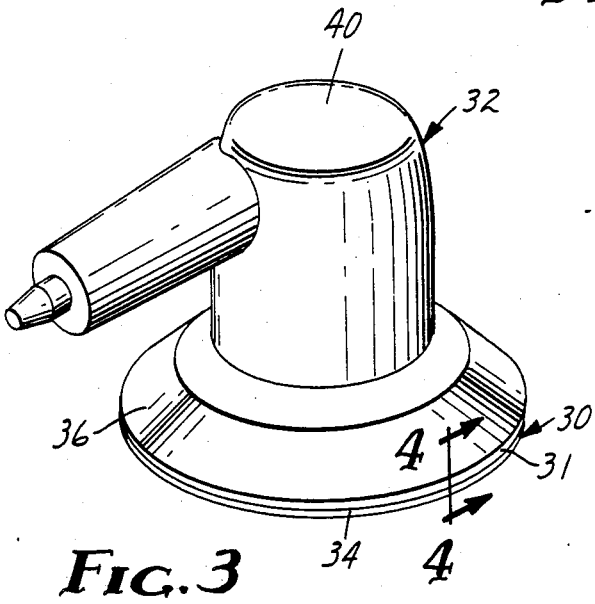
FIG. 3 shows a second embodiment of a coated abrasive sheet material according to the present invention shown magnetically attached to a magnetized pad on a rotary grinder.
Figure 4:
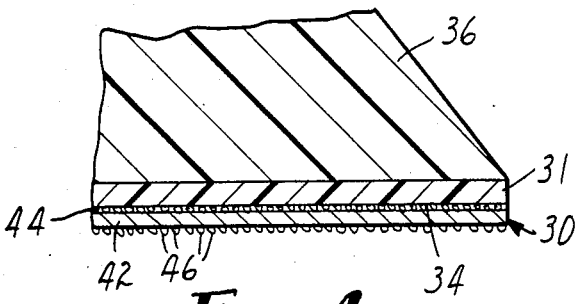
FIG. 4 is an enlarged sectional view taken approximately along Line 4—4 of FIG. 3.

Referring now to FIGS. 3 and 4 there is shown a piece of coated abrasive sheet material 30 and a flexible magnetized pad 31 according to the present invention adapted for use on a rotary grinder 32 of the type commonly used to finish metal such as the rotary grinder sold under the trade deisgnation Catalog No. 1200 "Portable Electric Polisher" by Sioux Tools, Inc., Sioux City, Iowa. The coated abrasive sheet material 30 is shown magnetically attached on a circular support surface 34 of the flexible magnetized pad 31, which support surface is generally planar which means that it could be flat or could be slightly convex or concave if desired to facilitate grinding certain workpieces. The magnetized pad 31 includes magnetized particles within a polymeric matrix, (e.g., a 0.15 centimeter thick pad 31 of "Plastiform" magnetized material having 18 magnetic poles per inch in one direction along the support surface 34), which magnetized pad 31 is mounted on a flexible polymeric circular backing layer or plate 36 of the rotary grinder 32. The grinder 32 includes a drive means including an electric motor 40 adapted to rotate the backing plate 36 and magnetized pad 31 at over 3,000 R.P.M. to abrade a workpiece (not shown). During such rotation only the force of magnetic attraction between the magnetized pad 31 and the flexible, relatively low mass, circular, coated abrasive sheet material 30 and any force applied to the sheet material 30 through the magnetized pad 31 normal to the support surface 34 will produce sufficient static friction between the support surface 34 and the coated abrasive sheet material 30 to retain the coated abrasive sheet material 30 on the support surface 34 while it is driven by the magnetized pad 31 to abrade the workpiece.

As is seen in FIG. 4, the coated abrasive sheet material 30 comprises a flexible backing sheet 42 having opposite major surfaces and a layer of abrasive grains 46 adhered on one major surface of the backing sheet 42 by a conventional bonding material. Magnetic attachment between the circular coated abrasive sheet material 30 and the magnetized pad 31 is provided by a layer 44 of ferromagnetic (e.g., iron) particles adhered to the major surface of the backing sheet 42 opposite the layer of abrasive grains 46, which layer 44 has a uniform density of over about 0.007 gram (and preferably in the range of about 0.015 to 0.03 gram) of ferromagnetic material per square centimeter of area measured in a plane parallel to the major surfaces of the backing sheet 42.

Figure 5:
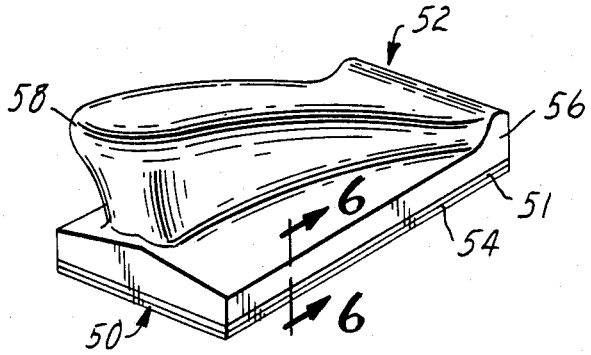
FIG. 5 shows a third embodiment of a coated abrasive sheet material according to the present invention shown magnetically attached to a magnetized pad on a hand sanding block.
Figure 6:
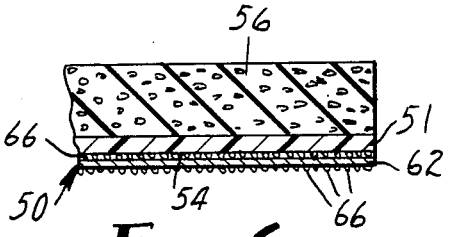
FIG. 6 is an enlarged fragmentary sectional view taken approximately along Line 6—6 of FIG. 5.

Referring now to FIGS. 5 and 6 there is shown a piece of coated abrasive sheet material 50 and a flexible magnetized pad 51 according to the present invention adapted for use on a hand sanding block 52 of the type commonly used by home craftsman such as the hand sanding block 52 made of flexible foam rubber and sold under the trade designation "Soft Hand Block", part no. 5442, by Minnesota Mining and Manufacturing Company. The coated abrasive sheet material 50 is rectangular and is shown magnetically attached on a rectangular support surface 54 of the flexible magnetized pad 51. The support surface 54 is generally planar which means that the surface could be flat or could be slightly arcuate around a transverse or longitudinal axis as may be desired to facilitate abrading certain contoured workpieces. The magnetized pad 51 comprises magnetized particles within a polymeric matrix (e.g., a 0.15 centimeter thick magnetized pad 51 of the magnetized material commercially designated "Plastiform" sold by Minnesota Mining and Manufacturing Company of St. Paul, Minn. and having 18 magnetic poles per inch in one direction along the support surface 54). The magnetized pad 51 is adhered on a planar surface of a molded foamed polypropylene upper portion 56 of the hand sanding block 52 which includes a projection 58 adapted to be manually grasped so that the block 52 can be manipulated to abrade a substrate (not shown). During such manipulation only the force of magnetic attraction between the magnetized pad 51 and the flexible, relatively low mass rectangular coated abrasive sheet material 50 and any force applied to the sheet material 50 through the magnetized pad 51 normal to the support surface 54 will produce sufficient static friction between the support surface 54 and the coated abrasive sheet material 50 to retain the coated abrasive sheet material 50 on the support surface 54 while it is driven by the magnetized pad 51 to abrade the workpiece.

As is best seen in FIG. 6, the coated abrasive sheet material 50 comprises a flexible backing sheet 62 having opposite major surfaces and a layer 66 of abrasive grains adhered on both major surfaces by a conventional bonding material. Magnetic attachment between the piece 50 of coated abrasive sheet material and the magnetized pad 51 is provided by a layer of ferromagnetic (e.g., iron) particles having a uniform density of over about 0.007 grams (and preferably in the range of about 0.01 to 0.05 gram) per square centimeter of area measured in a plane parallel to the major surfaces of the backing sheet 62, which ferromagnetic particles are incorporated in both layers 66 of abrasive grains 66 so that either layer 66 of abrasive grain may be position on the support surface 54 to permit use of the other layer 66 of abrasive grain to abrade a workpiece.

Referring now to FIGS. 7, 8, 9 and 10 there are illustrated fourth, fifth, sixth, and seventh alternate embodiments respectively of flexible coated abrasive sheet materials 70, 80, 90 and 100 according to the present invention, which sheet materials 70, 80, 90 and 100 could be magnetically attached to and be of an appropriate size and shape to be used on a support surface of a flexible magnetized pad including magnetized particles within a polymeric matrix, such as the magnetized pads 11, 31 and 51 described above.

Figure 7:
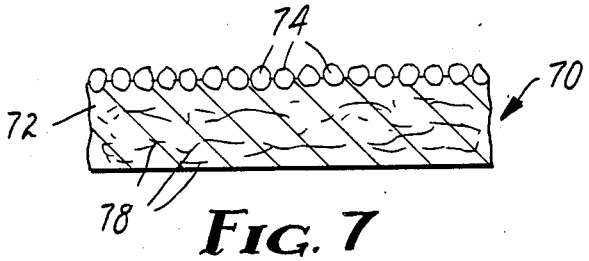
FIGS. 7, 8, 9 and 10 are fragmentary sectional views of fourth, fifth sixth, and seventh embodiments of coated abrasive sheet materials according to the present invention.

The embodiment of the flexible coated abrasive sheet material 70 illustrated in FIG. 7 comprises a backing sheet 72 having opposite major surfaces, a layer of abrasive grains 74 adhered on one of the major surfaces by a conventional bonding material, and a uniform density of over about 0.007 gram (and preferably in the range of about 0.02 to 0.07 gram) of ferromagnetic (e.g., iron) fibers 78 per square centimeter of area measured in a plane parallel to the major surfaces which fibers 78 were incorporated in the backing sheet 72 at the time the backing sheet 72 was made.

Figure 8:
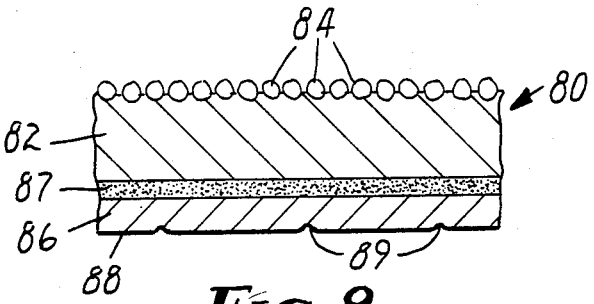

The embodiment of the flexible coated abrasive sheet material 80 illustrated in FIG. 8 comprises a backing sheet 82 having opposite major surfaces, a layer of abrasive grains 84 adhered on one of the major surfaces by a conventional bonding material, and a thin sheet 86 of ferromagnetic material (e.g., shim steel) adhered by an adhesive layer 87 to the major surface of the backing sheet 82 opposite the layer of abrasive grains 84 and providing a uniform density of over about 0.007 gram (and preferably in the range of about 0.01 to 0.05 gram) of the ferromagnetic material per square centimeter of area measured in a plane parallel to the major surfaces of the backing sheet 82. The sheet 86 of ferromagnetic material is embossed on its surface 88 opposite the backing sheet 82 both to improve its coefficient of friction with a support surface, and to provide recesses 89 which can receive dust that may become trapped between the surface 88 and the support surface of a magnetic pad on which the sheet material 80 is attached, thereby restricting the separation and the lubrication or bearing effect between those surfaces that the dust might otherwise provide to promote slippage between the sheet material and the support surface in the plane of the surface 88.

Figure 9:
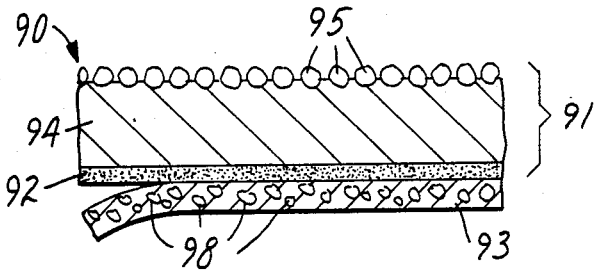

The embodiment of the flexible coated abrasive sheet material 90 illustrated in FIG. 9 is the result of modifying a commercially available piece 91 of coated abrasive sheet material, including a layer 92 of pressure sensitive adhesive by which the piece 91 may be adhered to a support surface of a non-magnetized pad (such as the sheet material sold under the trade designation "STI-KIT" by Minnesota Mining and Manufacturing Company, St. Paul, Minn.) by applying a linear sheet 93 comprising ferromagnetic material so that the combination of the commercially available piece 91 and liner sheet 93 can be magnetically attached on the support surface of a magnetized pad such as the pads 11, 31 and 51 described above. The commercially available piece 91 comprises a backing sheet 94 having opposite major surfaces, a layer of abrasive grains 95 adhered on one of the major surfaces by a conventional bonding material, and the layer 92 of pressure-sensitive adhesive on the major surface of the backing sheet 94 opposite the layer of abrasive grains 95. The liner sheet 93 (e.g., 0.005 centimeter thick polyethylene) overlays the surface of the layer 92 of pressure-sensitive adhesive, and is filled with ferromagnetic granules 98 which were mixed with the material from which the liner sheet 93 was extruded to provide a uniform density of over about 0.007 gram (and preferably in the range of about 0.02 to 0.04 gram) of the ferromagnetic material per square centimeter of area measured in a plane parallel to the major surfaces of the backing sheet 94. The coated abrasive sheet material 90 as illustrated can be magnetically attached to a support surface of a flexible magnetized pad including magnetized particles within a polymeric matrix, such as the pads 11, 31 and 51 described above, or the liner sheet 93 including the ferromagnetic granules 98 can be pealed away, and the remaining commercially available piece 91 of coated abrasive sheet material can be adhered by the layer 92 of pressure-sensitive adhesive to the support surface on a non-magnetized pad.

Figure 10:
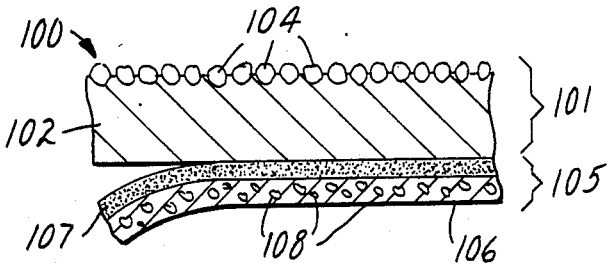

The embodiment of the flexible coated abrasive sheet material 100 illustrated in FIG. 10 is the result of modifying a conventional commercially available piece 101 of coated abrasive sheet material (which commercially available piece 101 includes a backing sheet 102 having opposite major surfaces, and a layer 104 of abrasive grains adhered on one of the major surfaces of the backing sheet 102 by a conventional bonding material) by the application of a laminate 105 comprising ferromagnetic material so that the commercially available sheet 101 can be magnetically attached on the support surface of the magnetized pad, such as the pads 11, 31 and 51 described above. The laminate 105 comprises a liner sheet 106 (e.g., 0.038 centimeter thick polyethylene) which, like the liner sheet 93, is filled with ferromagnetic granules 108 to provide a uniform density of over about 0.007 gram (and preferably in the range of about 0.02 to 0.04 grams) of the ferromagnetic material per square centimeter of area measured in a plane parallel to the major surfaces of the liner sheet 106, and a layer 107 of pressure-sensitive adhesvie originally coated on the liner sheet 106 by which layer 107 the laminate 105 is adhered to the major surface of the backing sheet 102 opposite the layer of abrasive grains 104. The commercially available piece 101 of coated abrasive sheet material may be modified in the field by applying the laminate 105 to produce the coated abrasive sheet material 100 that can be magnetically attached to a maganetized pad.

Alternatively, either of the liner sheets 93 or 106 in the embodiments 90 or 100 of the coated abrasive sheet material shown in FIGS. 9 and 10 could be replaced by a liner sheet having a layer of ferromagnetic particles adhered on its surface opposite the layer of pressure sensitive adhesive in the manner the layers 28 and 44 of ferromagnetic particles are adhered on the backing sheets 22 and 42 in FIGS. 2 and 4; or could be replaced by a sheet of ferromagnetic material such as the sheet 86 shown in FIG. 8.

Test Results

Figure 11:
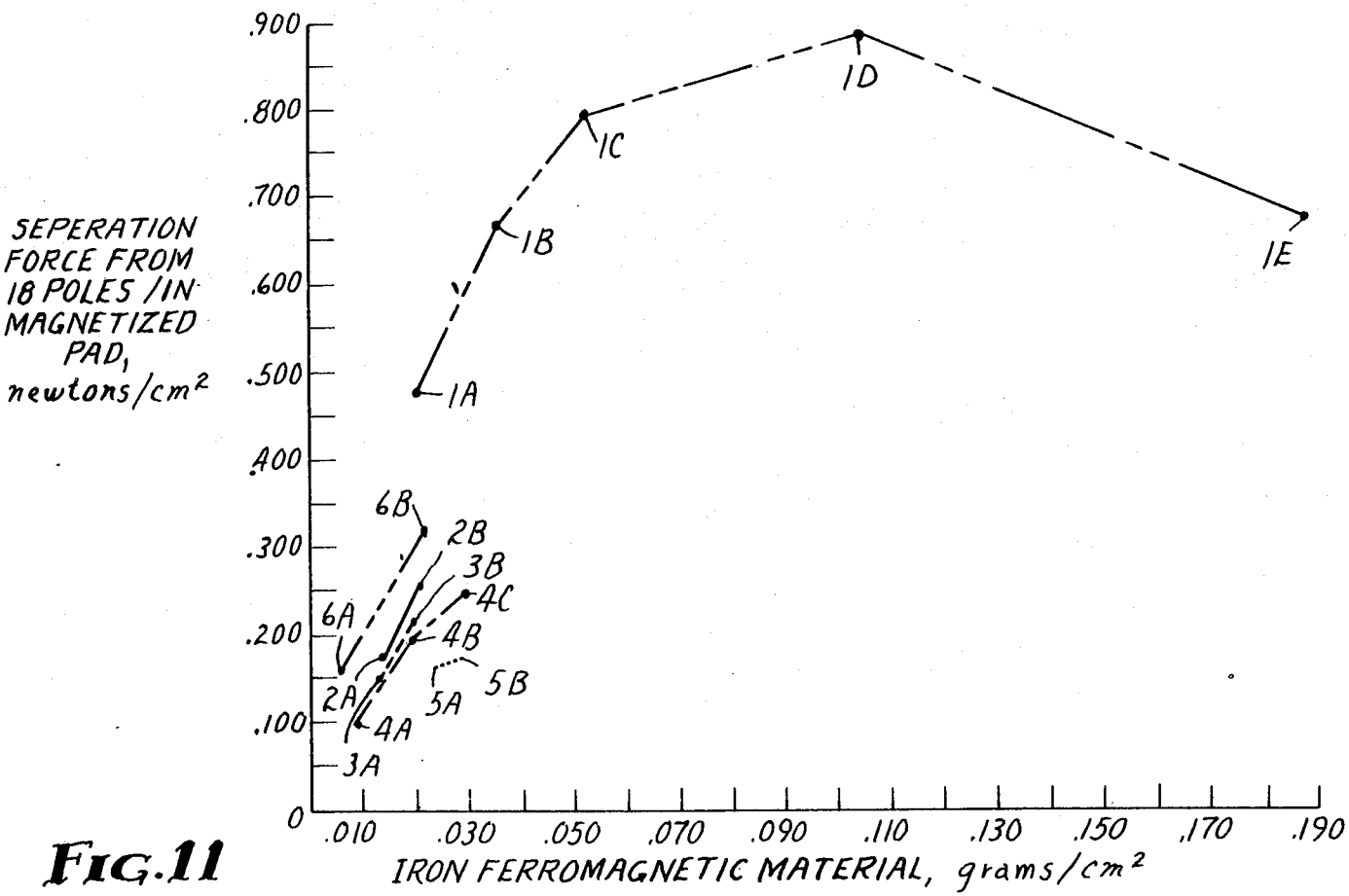
FIGS. 11, 12 and 13 are graphs showing results for tests reported in this application.
Figure 12:
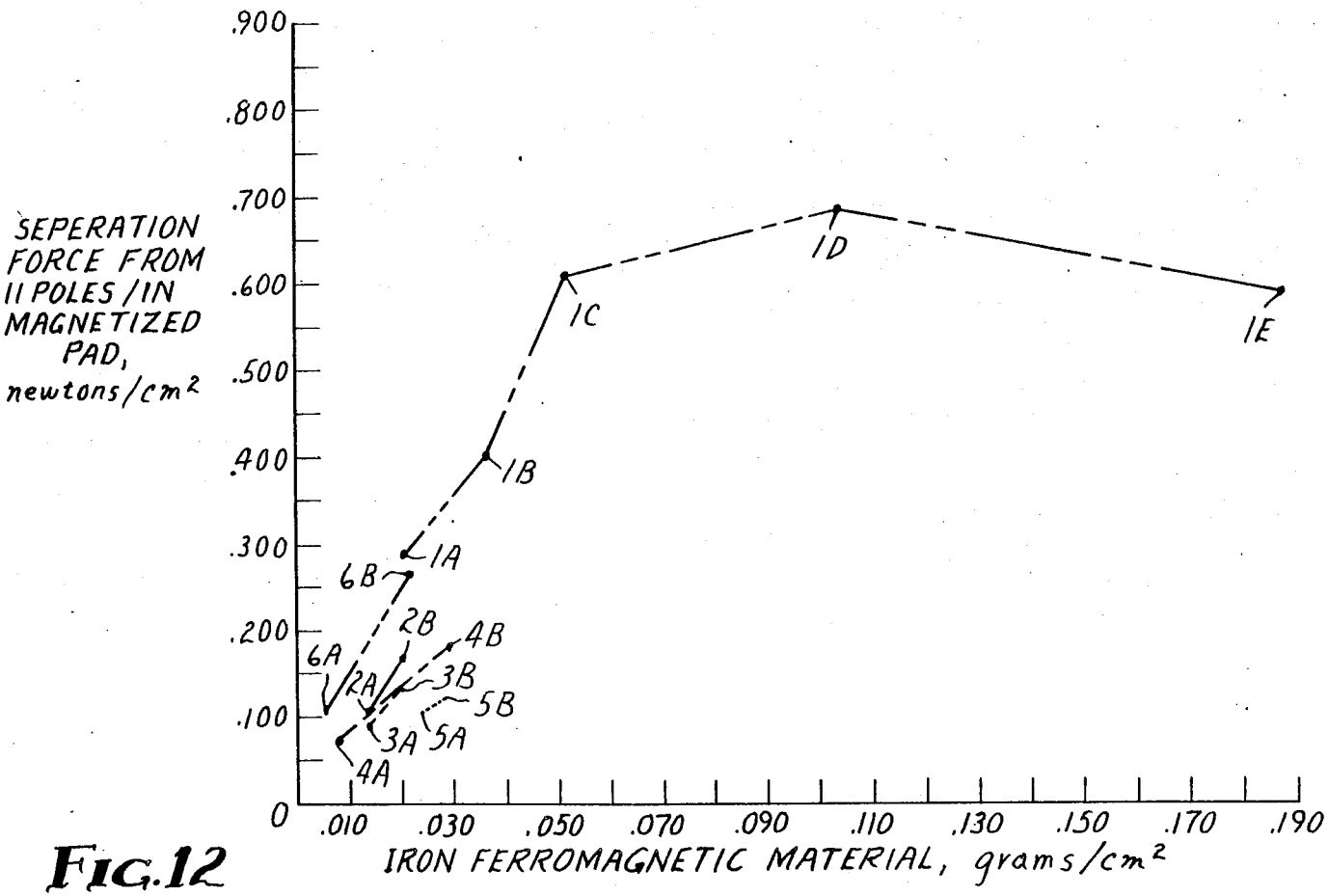
Figure 13:
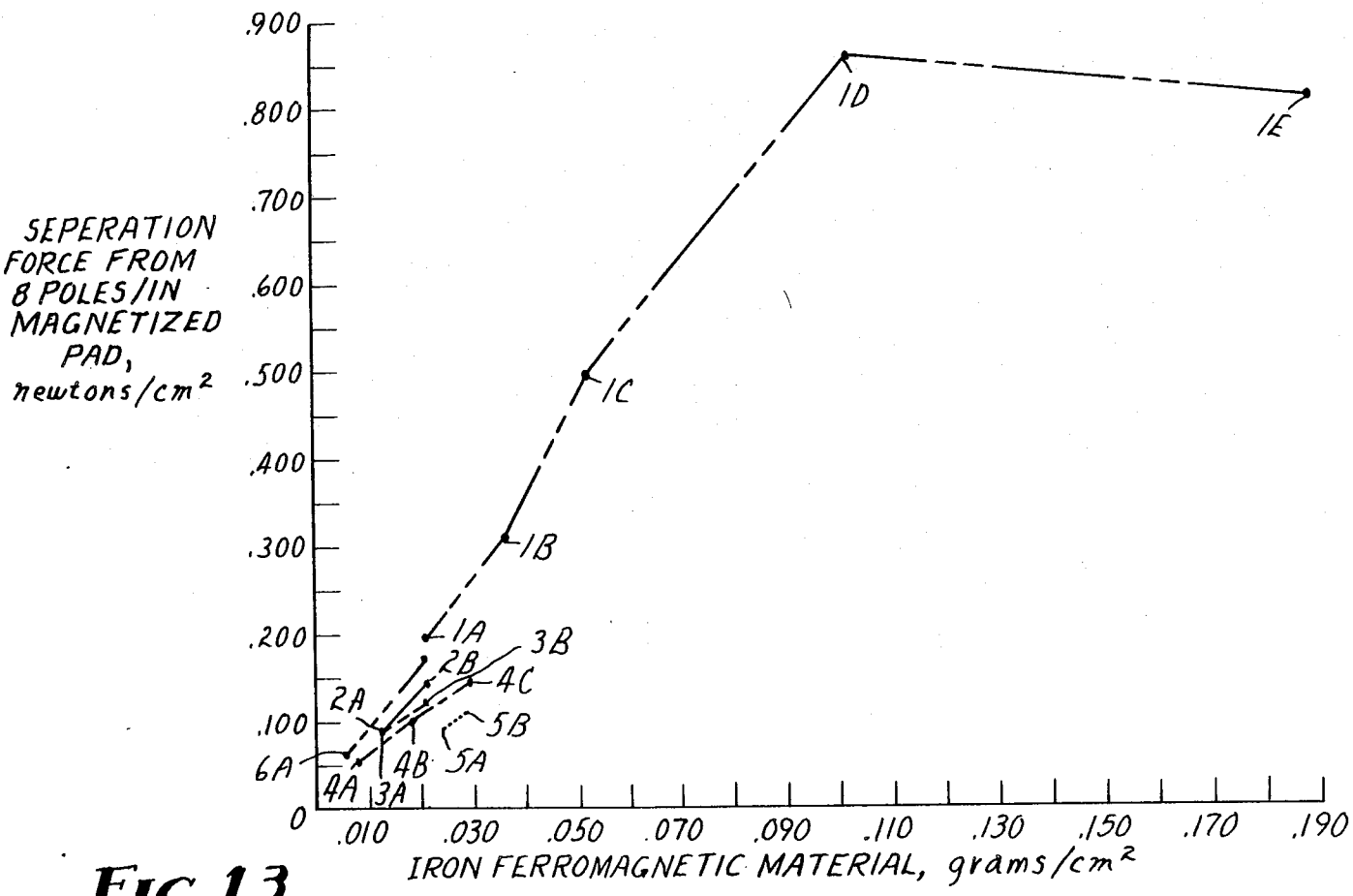

The following describes several tests, the results of which are graphed in FIGS. 11, 12, and 13 and shown in the table at the end of this specification. The tests were made to determine the force of magnetic attraction that will result between magnetized pads having 18 (FIG. 11), 11 (FIG. 12) or 8 (FIG. 13) magnetic poles per inch along their support surfaces, and various embodiments of coated abrasive sheet material according to the present invention incorporating varying amounts of iron ferromagnetic material.

Test No. 1

Pieces of coated abrasive sheet material having structures generally like the coated abrasive sheet material 80 illustrated in FIG. 8 were made and tested. Pieces of shim steel commercially designated QQ-S-698 C-10-10 No. 1 temper obtained from Baisdell Manufacturing, Inc., Buena Park, Calif., 90622, and nominally 0.0025, 0.0051, 0.0076, 0.0127, and 0.0254 centimeter (0.001, 0.002, 0.003, 0.005 and 0.010 inch) thick, were adhered to the layers of pressure sensitive adhesive on the surfaces opposite the layers of abrasive grains on the backing sheets of commercially available pieces of coated abrasive sheet material commercially designated "STI-KIT" and manufactured by Minnesota Mining and Manufacturing Company of St. Paul, Minn. Several 7 centimeter ($2\frac{3}{4}$ inch) by 41.9 centimeter ($16\frac{1}{2}$ inch) rectangular pieces of the resulting coated abrasive sheet material were die cut using a hydraulic press, along with several pieces of each thickness of the shim steel which were weighed on a laboratory balance to determine the weight of ferromagnetic material in each sample for each thickness of shim steel.

The samples were then sequentially attached along their abrasives coated surfaces to a 1.27 centimeter ($\frac{1}{2}$ inch) thick by 7 centimeter ($2\frac{3}{4}$ inch) wide by 41.9 centimeter ($16\frac{1}{2}$ inch) long rectangular block of aluminum using Acrylic Foam Tape No. Y 4205 available from Minnesota Mining and Manufacturing Company of St. Paul, Minn. such that the shim steel could be placed in intimate contact along the support surface of various 0.03 inch thick magnetized pads of the flexible material including magnetized particles within a polymeric matrix of the type commercially designated "Plastiform", of the 8, 11, and 18 poles per inch variety, which magnetized pads were secured to the load platform of a Type 9281B "Kistler" testing device available from Kistler Instrument Corp., Amherst, N.Y., that was used to electronically measure the force required to separate the samples from the magnetized pads. The results of the tests labeled 1A, 1B, 1C, 1D and 1E are shown in FIGS. 11, 12 and 13 for the 18, 11, and 8 poles per inch "Plastiform" material magnetized pads respectively, and are recorded in the table at the end of this specification.

As can be seen, the holding force between the sample coated abrasive materials and the magnetized pads increased as the thickness of shim steel increased so long as the shim steel provided less than about 0.1 grams per square centimeter of ferromagnetic material, and then began to decrease for shim steel which provided more than about 0.1 gram per square centimeter of ferromagnetic material. Also, it was separately judged that shim steels having thickness of 0.0127 centimeter and 0.0254 centimer (0.005 inch and 0.010 inch) did not have sufficient flexibility for use in the present invention as when such shim steels were bent 180 degrees around a 1 centimeter (⅜ inch) diameter rod under the conditions indicated above in this specification they were not held flat against the support surface of the 11 pole per inch magnetized pad of "Plastiform" material by the magnetic field from that pad. Shim steels having thickness of 0.0025, 0.0051 and 0.0076 centimeter (0.001, 0.002 and 0.003 inch) were found to have sufficient flexibility to pass this test.

Test No. 2

Backing sheets for coated abrasive sheet material having a layer of iron particles adhered on one surface like the backing sheets 22 and 42 and layers 28 and 44 of ferromagnetic particles illustrated in FIGS. 2 and 4 were made and tested. 100 pound batches of iron granules commercially designated MH 100 and obtained from Hoeganaes Corporation, Riverton, N.J., 08077, were placed in an 11 gallon ball mill with 316 pounds of about 1.5 centimeter (⅝ inch) diameter steel balls and milled dry for 20 to 22 hours to produce flat platelet-shaped granules of iron. The milled iron granules were then screened through a 180 mesh screen, and the course iron granules were discarded. A slurry was then prepared using 57.4% by weight of the milled screened platelet-shaped iron granules, 25.6% by weight of a polyester resin having 40% solids, 9.5% by weight of a polyester resin having 30% solids, 2.6% by weight of methyl ethyl keytone, 2.6% by weight of toluene, 0.4% by weight of wetting agent, and 1.9% by weight of isocyanate crosslinking agent. The slurry was then coated at various coating weights using a Gravure Roll coater onto "D" weight paper obtained from James River Corp. of Virginia, Richmond, Va. at a slurry viscosity of about 1,000 centipoise and a temperture of about 70 degrees Fahrenheit and allowed to dry. Samples of the resultant coated papers and of the uncoated paper were then die cut and weighed using the same equipment used in Test No. 1, and the weight of iron in each sample of coated paper was calculated by subtracting the sample paper weights from the weights of the coated samples to determine the weight of the ferromagnetic material containing coating, and by then calculating the weight of ferromagnetic material in each sample as being the percentage by dry weight that the ferromagnetic material was in the slurry from which it was coated. The force to separate the sample coated paper was determined using the "Kisler" testing device in the manner described above in Test No. 1. The results are shown on the graphs of FIGS. 11, 12 and 13 where they are labeled as points 2A and 2B, and are recorded in the table at the end of this specification.

While the magnetic holding force for equivalent amounts of ferromagnetic material per unit area was not as great in the samples produced in this Test No. 2 as for the Samples produced in Test No. 1, the resultant samples were much more flexible.

Test No. 3

Backing sheets for coated abrasive sheet material having a layer of iron particles adhered on one surface like the backing sheets 22 and 42 and layers 28 and 44 of ferromagnetic particles illustrated in FIGS. 2 and 4 were made and tested. 74.1% by weight of milled screened platelet-shaped iron granules prepared as described in Test No. 2 were thoroughly mixed with 25.5% by weight of latex SBR having 45% solids (e.g., No. 219A from Dow Chemical Company) and 0.4% by weight of acrylic emulsion thickener having 13% solids (e.g., Cruthix No. 46 from Crucible Chemical Co., Greenville, S.C.) to produce a latex water based slurry having a viscosity of about 8,000 centipoise which helped keep the iron granules in suspension. The slurry was knife coated at different thicknesses onto "D" weight paper obtained from James River Corp. of Virginia, Richmond, Va. at a temperature of 70 degrees Fahrenheit and allowed to dry. Samples of the resultant coated papers and of the uncoated paper were then die cut and weighed using the same equipment used in Test No. 1, and the weight of iron in each sample of coated paper was calculated by subtracting the sample paper weights from the weights of the coated samples to determine the weight of the ferromagnetic material containing coating, and then calculating the weight of ferromagnetic material in each sample as being the percentage by dry weight that the ferromagnetic material was in the slurry from which it was coated. The force to separate the sample coated paper was detrmined using the "Kisler" testing device in the manner described above in Test No. 1. The results are shown on the graphs of FIGS. 11, 12 and 13 where they are lableled as points 3A and 3B, and are recorded in the table at the end of this specification.

While the magnetic holding force for equivalent amounts of ferromagnetic material per unit area was not as great in the samples produced in this Test No. 3 as for the samples produced in Test No. 1, the resultant samples were much more flexible.

Test No. 4

Backing sheets for coated abrasive sheet material having a layer of iron particles adhered on one surface like the backing sheet 22 and 42 and layers 28 and 44 of ferromagnetic particles illustrated in FIGS. 2 and 4 were made and tested. 69.78% by weight of milled screened platelet-shaped iron granules prepared as described in Example 2 were thoroughly mixed with 14.96% by weight of ethylene vinyl acetate, 14.96% by weight of polyterpene tackifier resin and 0.3% by weight of antioxidant (e.g., Irganox 1010 available from Ciba-Geigy Corp., Washington, Pa.) to produce a hot-melt slurry. The slurry was roll coated onto "D" weight paper obtained from James River Corp. of Virginia, Richmond, Va., at a viscosity of 24,000 centipoise and a temperature of 300 degrees Fahrenheit and allowed to cool. Samples of the resultant coated paper and of the uncoated paper were then die cut and weighed using the same equipment used in Test No. 1, and the weight of iron in each sample of coated paper was calculated by subtracting the sample paper weights from the weights of the coated samples to determine the weight of the ferromagnetic material containing coating, and then calculating the weight of ferromagnetic material in each sample as being the percentage by weight that the ferromagnetic material was in the slurry from which it was coated. The force to separate the sample coated paper was determined using the "Kisler" testing device in the manner described above in Test No. 1. The results are shown on the graphs of FIGS. 11, 12 and 13 where they are labeled as points 4A, 4B and 4C, and are recorded in the table at the end of this specifiction.

While the magnetic holding force for equivalent amounts of ferromagnetic material per unit area was not was great in the samples produced in this Test No. 4 as for the samples produced in Test No. 1, the resultant samples were much more flexible.

Test No. 5

A steel fiber-filled flexible backing sheet like the backing sheet 72 shown in FIG. 7 was prepared using mild steel fibers commercially designated Type PS and obtained from Peerless Metal Powders, Inc., Detroit, Mich. 48209. The backing sheet was made on a Fourdinier-type paper making machine from a slurry of 1 part by weight of semi-bleached wood pulp (e.g., Prince George Wood Pulp, available from Canadian Forest Products, Ltd., Van Couver, British Columbia, Canada), 3.5 parts by weight of the steel fibers, 0.49 parts by weight of laytex having 50% solids (e.g., Hycar No. 1562X103 available from B. F. Goodrich, Akron, Ohio), 0.004 parts by weight of surfactant (e.g., Tamol SN available from Rohm and Haas, Philadelphia, Pa.), and 0.028 parts by weight of jet black dye. Samples of the resultant paper were then die cut and weighed using the same equipment used in Test No. 1, and the weight of the steel fibers in each sample of paper was calculated as being the percentage by dry weight that the ferromagnetic material was in the slurry from which the paper was made. The force to separate the samples of steel fiber filled paper were determined using the "Kisler" testing device in the manner described above in Test No. 1. The results are shown on the graphs of FIGS. 11, 12 and 13 where they are labeled as points 5A and 5B, and are recorded in the table at the end of this specification.

The magnetic holding force for equivalent amounts per unit area of ferromagnetic material was not as great in the samples produced in this Test No. 5 as for the samples produced in Test No. 1 or as for the samples produced in Test Nos. 2, 3 and 4. The resultant samples were much more flexible than the samples from Test No. 1, however, and at least as flexible as the samples from the other Tests.

Test No. 6

Backing sheets for coated abrasive sheet material having a layer of iron particles adhered on one surface like the backing sheets 22 and 42 and layers 28 and 44 of ferromagnetic particles illustrated in FIGS. 2 and 4 were made and tested. A pre-mix was prepared using 12,027 grams of iron granules commercially designated MH 100, obtained from Hoeganaes Corporation, Riverton, N.J., 193.1 grams of methyl ethyl keytone, 193.1 grams of toluene, and 5.3 grams of wetting agent. The pre-mix was placed in a 2.3 gallon ceramic ball mill with 12.9 kilograms of about 1.5 centimeter ($\frac{3}{8}$ inch) diameter steel balls and milled for about 24 hours to start forming the iron into flat platelet-shaped granules. 142 grams of a polyester resin having 40% solids, 383.4 grams of polyester resin have 30% solids, 317.2 grams of methyl ethyl keytone, and 317.2 grams of toluene were then added to the pre-mix in the ball mill. The resultant mixture was again milled for about 20 hours to further form the iron into flat platelet-shaped granules, and was then screened through a 4 mesh screen to remove the steel balls. The resultant slurry was then coated at various coating weights using a knife coater onto "A" weight paper obtained from James River corp. of Virginia, Richmond, Va. at a slurry viscosity of about 66 Kreb units and a temperature of about 70 degrees Fehrenheit and allowed to dry. Samples of the resultant coated papers and of the uncoated paper were then die cut and weighed using the same equipment used in Test No. 1, and the weight of iron in each sample of coated paper was calculated by subtracting the sample paper weights from the weights of the coated samples to determine the weight of the ferromagnetic material containing coating, and by then calculating the weight of ferromagnetic material in each sample as being the percentage by dry weight that the ferromagnetic material was in the slurry from which it was coated. The force to separate the sample coated paper was determined using the "Kisler" testing device in the manner described above in Test No. 1. The results are shown on the graphs of FIGS. 11, 12 and 13 where they are labeled as points 6A and 6B, and are recorded in the table at the end of this specification.

While the magnetic holding force for equivalent amounts of ferromagnetic material per unit area was not as great in the samples produced in this Test No. 6 as for the Samples produced in Test No. 1, the resultant samples were much more flexible, and had the best magnetic holding force for samples including granular iron.

TABLE

| Test Number | Amount of Ferromagnetic Material gm/cm$^2$ | Separating Force from 18 Poles/inch Magnetized Pad, Newtons/cm$^2$ | Separating Force from 11 Poles/inch Magnetized Pad, Newtons/cm$^2$ | Separating Force from 8 Poles/inch Magnetized Pad, Newtons/cm$^2$ |
|---|---|---|---|---|
| 1 | 0.020 | 0.479 | 0.289 | 0.194 |
| (shim steel) | 0.036 | 0.667 | 0.403 | 0.312 |
| | 0.051 | 0.790 | 0.608 | 0.489 |
| | 0.102 | 0.882 | 0.684 | 0.851 |
| | 0.187 | 0.669 | 0.578 | 0.806 |
| 2 | 0.021 | 0.258 | 0.167 | 0.141 |
| (dry milled granules | 0.014 | 0.175 | 0.103 | 0.087 |

TABLE-continued

| Test Number | Amount of Ferromagnetic Material gm/cm$^2$ | Separating Force from 18 Poles/inch Magnetized Pad, Newtons/cm$^2$ | Separating Force from 11 Poles/inch Magnetized Pad, Newtons/cm$^2$ | Separating Force from 8 Poles/inch Magnetized Pad, Newtons/cm$^2$ |
|---|---|---|---|---|
| adhered by polyester adhesive) | | | | |
| 3 | 0.019 | 0.213 | 0.137 | 0.114 |
| (dry milled granules | 0.013 | 0.148 | 0.091 | 0.084 |
| adhered by latex adhesive) | | | | |
| 4 | 0.029 | 0.247 | 0.182 | 0.141 |
| (dry milled granules | 0.019 | 0.198 | 0.137 | 0.103 |
| adhered by Hotmelt adhesive) | 0.009 | 0.099 | 0.072 | 0.053 |
| 5 | 0.028 | 0.175 | 0.118 | 0.103 |
| (steel fibers in | 0.024 | 0.163 | 0.106 | 0.091 |
| backing layer) | | | | |
| 6 | 0.007 | 0.159 | 0.110 | 0.061 |
| (wet milled granules | 0.022 | 0.317 | 0.268 | 0.165 |
| adhered by polyester adhesive) | | | | |

I claim:

1. In combination, an abrading tool comprising a flexible backing layer and a flexible magnetized pad fixed on one surface of said flexible backing layer, having a generally planar support surface on its side opposite said flexible backing layer, and providing more than 6 magnetic poles per inch in at least one direction along said support surface; and a flexible, low mass piece of coated abrasive sheet material on said support surface, said coated abrasive sheet material including a backing sheet having opposite major surfaces, having abrasive grains attached on at least one of said major surfaces, and incorporating sufficient ferromagnetic material in a plane parallel to said major surfaces that only the force of magnetic attraction between said magnetized pad and the ferromagnetic material incorporated with the coated abrasive sheet material and any force applied to the sheet material through the magnetized pad normal to said support surface will produce sufficient static friction between said support surface and said coated abrasive sheet material to retain said abrasive coated sheet material on said support surface while it is driven at high speed by said magnetized pad to abrade a workpiece.

2. A combination according to claim 1 wherein said ferromagnetic material is iron, and said coated abrasive sheet material includes an average in the range of about 0.007 to 0.1 gram of the iron per square centimeter area measured in said plane parallel to said major surfaces.

3. A combination according to claim 1 wherein said ferromagnetic material is iron granules adhered on the major surface of said backing sheet opposite the abrasive grains.

4. A combination according to claim 3 wherein said granules are platelet shaped.

5. A combination according to claim 1 wherein said ferromagnetic material is a thin steel sheet adhered on the surface of said backing sheet opposite said abrasive grains.

6. A combination according to claim 1 wherein said ferromagnetic material is in the form of fibers incorporated in said backing sheet.

7. A combination according to claim 1 wherein said coated abrasive sheet material has abrasive grains attached on both of said major surfaces and said ferromagnetic material is in the form of granules incorporated with said abrasive grains.

8. A combination according to claim 1 wherein said coated abrasive sheet material can be bent at least 180 degrees around a 1 centimeter diameter rod at a temperature of 70 degrees Fahrenheit and at relative humidity of 50%, and will subsequently be held flat against a flat surface of an 11 pole per inch magnetized pad of "Plastiform" brand magnetic material by only the magnetic attraction between the magnetic poles in the pad and the ferromagnetic material in the coated abrasive sheet material.

9. A combination according to claim 1 wherein said magnetized pad is flexible and includes magnetized particles within a polymeric matrix that provide 11 or 18 magnetic poles per inch in at least one direction along said support surface.

10. A combination according to claim 1 wherein said piece of coated abrasive sheet material has an average density of less than about 0.45 gram per square centimeter measured in a plane parallel to said major surfaces.

11. A flexible coated abrasive sheet material adapted to be magnetically held on a support surface of a flexible magnetized pad providing more than 6 magnetic poles per inch in one direction along the support surface, said coated abrasive sheet material comprising a backing sheet having opposite major surfaces, abrasive grains adhered on at least one of said surfaces, and an average of over about 0.007 grams of small separate pieces of ferromagnetic material per square centimeter area measured in a plane parallel to said major surfaces so that only the force of magnetic attraction between said magnetized pad and the coated abrasive sheet material and any force applied to the coated abrasive sheet material through the magnetized pad normal to said support surface will produce sufficient static friction between said support surface and said coated abrasive sheet material to retain said coated abrasive sheet material on said support surface while it is driven by the magnetized pad to abrade a workpiece.

12. A sheet material according to claim 11 wherein said ferromagnetic material is iron granules adhered in a layer on the surface of the backing sheet opposite the abrasive grains.

13. A sheet material according to claim 12 wherein said granules are platelet-shaped.

14. A sheet material according to claim 11 wherein said ferromagnetic material is iron and said coated abrasive sheet material includes up to about 0.1 grams of the iron material per square centimeter area measured in a plane parallel to said major surfaces.

15. A sheet material according to claim 11 wherein said ferromagnetic material is the form of iron fibers incorporated in said backing sheet.

16. A sheet material according to claim 11 wherein said coated abrasive sheet material has abrasive grains adhered on both of said major surfaces and said ferromagnetic material is in the form of granules and is incorporated with the abrasive grains.

17. A sheet material according to claim 11 having a generally uniform density of the ferromagnetic material in said plane parallel to said major surfaces.

18. A sheet material according to claim 11 having an average density of less than about 0.45 gram per square centimeter measured in a plane parallel to said major surfaces.

19. A sheet material according to claim 11 that can be bent at least 180 degrees around a 1 centimeter diameter rod at a temperature of 70 degrees Farenheit and at a relative humidity of 50%, and will subsequently be held flat against a flat surface of an 11 pole per inch magnetized pad of "Plastiform" brand magnetic material by oly the magnetic attraction between the magnetic poles in the pad and the ferromagnetic material in the coated abrasive sheet material.

* * * * *